US007753542B2

(12) United States Patent
Bruce et al.

(10) Patent No.: US 7,753,542 B2
(45) **Date of Patent: *Jul. 13, 2010**

(54) MOUNTABLE LINEAR LIGHT WELT

(76) Inventors: Kevin Bruce, 522 S. Lake Roesiger Rd., Snohomish, WA (US) 98290; Luis Lorca-Merono, 522 S. Lake Roesiger Rd., Snohomish, WA (US) 98290

( * ) Notice: Subject to any disclaimer, the term of this patent is extended or adjusted under 35 U.S.C. 154(b) by 0 days.

This patent is subject to a terminal disclaimer.

(21) Appl. No.: 12/283,914

(22) Filed: Sep. 15, 2008

(65) Prior Publication Data

US 2009/0141475 A1 Jun. 4, 2009

Related U.S. Application Data

(63) Continuation of application No. 10/152,364, filed on May 20, 2002, now Pat. No. 7,425,079, and a continuation of application No. 29/138,485, filed on Mar. 12, 2001, now Pat. No. Des. 457,299.

(51) Int. Cl.
*F21V 9/16* (2006.01)
*F21V 5/00* (2006.01)

(52) U.S. Cl. ..... 362/84; 362/581; 362/223

(58) Field of Classification Search ..... 362/84, 362/581, 34, 103, 223, 311; 313/498, 483, 313/506, 511, 512, 346 R; 428/917
See application file for complete search history.

(56) References Cited

U.S. PATENT DOCUMENTS 3,161,797 A 12/1964 Butler et al
3,393,337 A * 7/1968 Panerai et al. ..... 313/509
4,024,404 A * 5/1977 Schroeder ..... 250/462.1
4,266,164 A * 5/1981 Schroeder ..... 315/169.1
4,724,327 A * 2/1988 Mitchell ..... 250/483.1
4,725,761 A * 2/1988 Schroeder et al. ..... 315/169.3
5,041,326 A * 8/1991 Schroeder et al. ..... 428/161
5,067,063 A 11/1991 Granneman et al.
5,245,517 A 9/1993 Fenton
5,485,355 A 1/1996 Voskoboinik et al.
5,676,451 A * 10/1997 Tabanera ..... 362/156
5,836,671 A 11/1998 Chien
5,869,930 A 2/1999 Baumberg et al.
6,074,071 A 6/2000 Baumberg et al.
6,082,867 A * 7/2000 Chien ..... 362/84
6,637,909 B1 * 10/2003 Bryan ..... 362/156
7,425,079 B2 9/2008 Bruce et al

* cited by examiner

*Primary Examiner*—Thuy Vinh Tran
(74) *Attorney, Agent, or Firm*—Dean A. Craine

(57) ABSTRACT

A mountable welt that is easier to attach to a desired surface or joint. The welt includes a transparent or semi-transparent sheath casing circular or oval in cross-section with at least one integrally formed, laterally extending wing member. The wing member is a relatively thin structure that extends longitudinally over a portion or the entire length of the outer casing. In the preferred embodiment, the outer surfaces of the wing member converge towards their outer edges thereby enabling the wing to be placed into a joint space. A suitable attachment method, such as sewing, an adhesive, or a closed joint, may be used to attach the wing to the desired surface or joint while allowing the outer casing to be exposed. Located inside the outer sheath is a continuous linear light.

10 Claims, 3 Drawing Sheets

MOUNTABLE LINEAR LIGHT WELT

This is a continuation application based on utility patent application (Ser. No. 10/152,364), filed May 20, 2002 now U.S. Pat. No. 7,425,079 and design patent application (Ser. No. 29/138,485) filed on Mar. 12, 2001, now U.S. Pat. No. D 457,299

BACKGROUND OF THE INVENTION

1. Field of the Invention

The present invention relates to flexible, tubular light sources and, more particularly to such products that can be easily mounted to a surface.

2. Description of the Related Art

Electroluminescence is the conversion of electrical energy into light by the activation of a phosphor layer by an alternating electrical current. Electroluminescent lighting consists of a layer of phosphor placed between two thin conductors which, when applied to a 400 to 2000 Hz AC circuit cause the layer of phosphor to rapidly charge and discharge and emit light. Dyes and filters are mixed or added to the electroluminescent lighting to emit specific colors. Also, inverters may be used to invert a DC power source from a battery into an alternating circuit at a specific current and voltage needed to cause electroluminescence. Examples of electroluminescent lighting are sold by Elam Electroluminescent Industries, Ltd, located in Jerusalem, Israel, under the trademark LyTec, and disclosed in U.S. Pat. Nos. 5,485,355 and 5,869,930, now incorporated herein.

The inner and outer conductors used in the electroluminescent lighting disclosed above are disposed inside a tubular-shaped outer insulation layer filed with an inner insulation layer. Because the outer insulation layer is circular in cross section, it is difficult to attached or mount securely to a flat surface or joint. Typically, clips or adhesives are used to attach the outer insulation layer to a flat surface which is cosmetically unacceptable in some applications.

What is needed is an improved lighting with an integrally attached structure that enables it to be easily mounted to a surface or joint.

SUMMARY OF THE INVENTION

It is an object of the present invention to provide a mountable linear light welt with an integrally attached wing that enables it to be easily mounted to a surface or joint. This object and other objects which will become apparent is met by the mountable light welt that includes an linear light source, such as an electroluminescent filament with a center conductor, and at least one outer conductor with an electroluminescent chemical dispersed therein that undergo electroluminescence when excited with by a suitable AC current. The welt includes a transparent or semi-transparent sheath casing which is circular or oval in cross-section designed to contain the linear light source. Integrally formed and laterally extending from the casing is a wing member. The wing member is a relatively thin structure that extends longitudinally over a portion or over the entire length of the outer casing. In the preferred embodiment, the outer edges of the wing member are converged towards their outer edges thereby enabling the wing to be placed into a joint space. A suitable attachment means, such as sewing thread, a suitable adhesive, or a closed welded joint may be used to mount the wing to the desired surface or joint while allowing the outer casing to be exposed.

DESCRIPTION OF THE PREFERRED EMBODIMENT(S)

Figure 1:
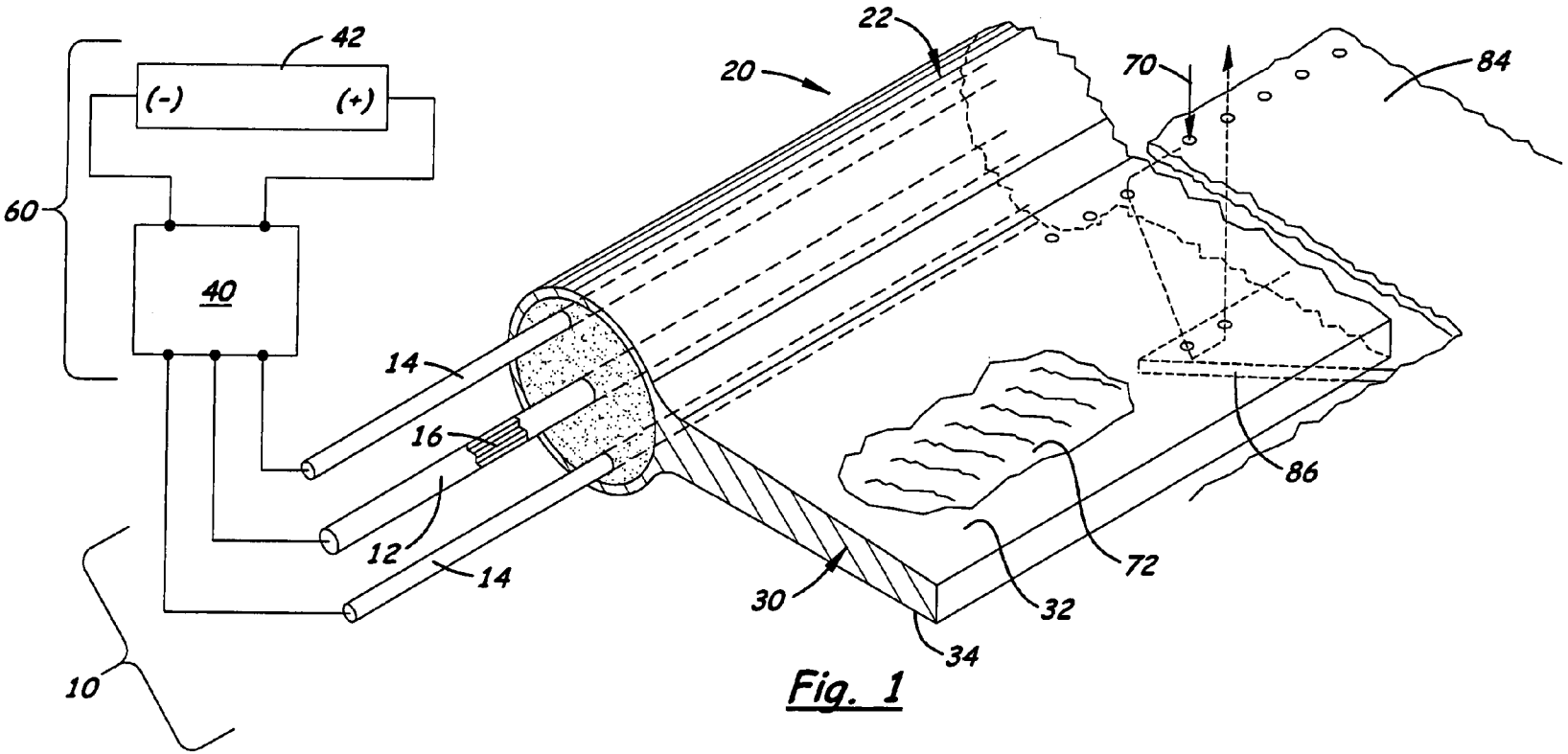
FIG. 1 is a perspective view of the mountable electroluminescent welt with one wing member.
Figure 2:
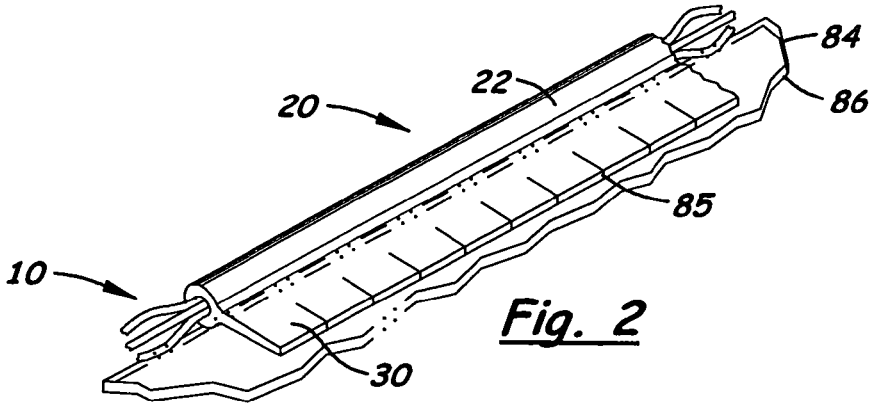
FIG. 2 is a perspective view of the invention of the mountable linear light welt with the wing member attached between two surfaces.
Figure 3:
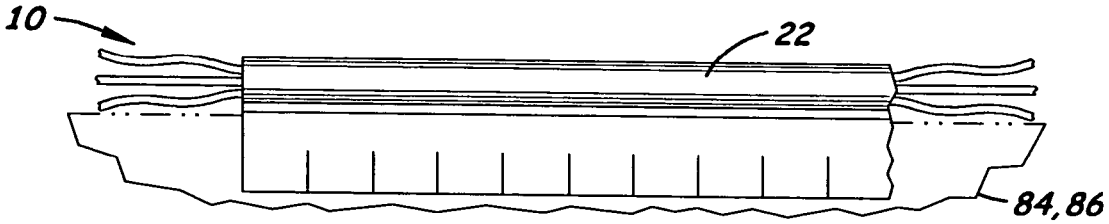
FIG. 3 is a top plan view of the invention shown in FIG. 2.
Figure 4:
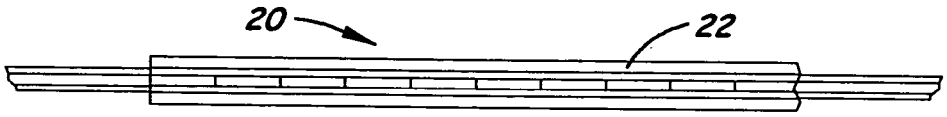
FIG. 4 is a side elevational view of the invention shown in FIGS. 2 and 3.
Figure 5:
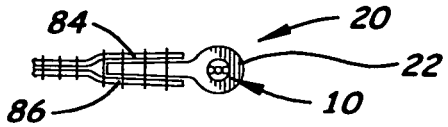
FIG. 5 is an end elevational view of the invention shown in FIGS. 2-4.

Shown in the accompanying FIGS. 1-8, is a mountable linear light welt 20 that includes a liner light source which may be an electroluminescent filament 10 with a center conductor 12 and at least one outer conductor 14, with an electroluminescent chemical 16 dispersed over the center conductor 12 that undergoes electroluminescence when excited with by a suitable AC power source 60. In the first embodiment, shown in FIGS. 1-5, the welt 20 includes a transparent or semi-transparent sheath casing 22 which is circular or oval in cross-section and designed to contain the electroluminescent filament 10. Integrally formed, laterally extending from the casing 22 is wing member 30. The wing member 30 is a relatively thin structure that extends longitudinally over a portion or the entire length of the outer casing 22. In the preferred embodiment, the top and bottom outer edges, 32, 34, respectively, of the wing member 30 converge towards their outer edges thereby enabling the wing member 30 to be placed into a narrow joint space without creating a bulge therebetween.

A suitable attachment means, such as sewing thread 70 or a suitable adhesive 72, or a closed frequency welded joint (not shown), may be used to mount the wing member 30 inside a joint between two desired surfaces 84, 86 while allowing the outer casing 22 to be exposed.

As mentioned above, the electroluminescent filament 10 is identical to the electroluminescent filaments disclosed in U.S. Pat. Nos. 5,485,355 and 5,869,930 and incorporated herein. Such electroluminescent filaments 10 are connected to an inverter 40 also disclosed in these patents and incorporated herein, with enables them to be used with a DC power source, i.e. battery 42.

Figure 6:
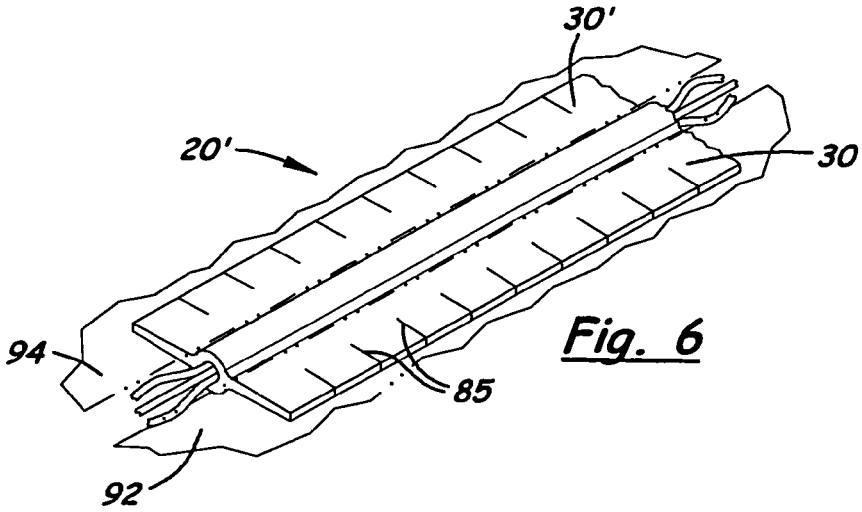
FIG. 6 is a perspective view of a second embodiment of the welt with two wing members disposed between to joined surfaces.
Figure 7:
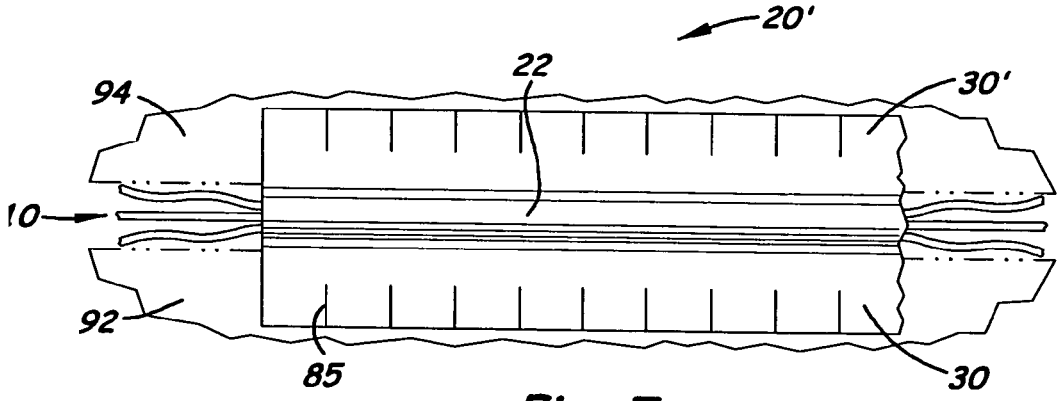
FIG. 7 is a top plan view of the welt shown in FIG. 6.
Figure 8:
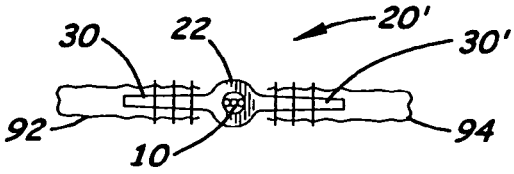
FIG. 8 is an end elevational view of the invention show in FIGS. 6 and 7.

Shown in FIGS. 6-8 is a second embodiment of the invention, denoted 20', which includes a first and second wing members 30, 30' both integrally formed on opposite sides of the outer casing 22. The second embodiment 20' is used between to opposite, parallel abutting surfaces 92, 94.

The outer casing 22 and wing member 30, 30' are made of polyvinyl chloride. The outer casing 22 may be any desired length. The wing member 30 may extend partially or the entire length of the outer casing 22. The width of the wing member 30 is approximately ⅜ of an inch and approximately ⅛ inch thick near the outer casing 22 and 1/16 inch think near its distal edge. Optional transversely aligned slits 85 may be formed on the wing member 30 that enable the wing member 30 to bend.

In compliance with the statute, the invention described herein has been described in language more or less specific as to structural features. It should be understood however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A continuously mountable linear light, comprising:

a. a transparent, continuous outer sheath casing;

b. a first continuous, wing member integrally formed with and extending laterally from said outer sheath casing, said first continuous wing member extends substantially the entire length of said outer sheath casing, thereby enabling said outer sheath casing to be continuously attached along its entire length to a support surface or object by continuously attaching said first continuous wing member to the support surface or object; and, c. a linear electric light source located inside said casing.

2. The continuously mountable linear light, as recited in claim 1, wherein said outer sheath casing and said first continuous wing member are made of polyvinyl chloride.

3. The continuously mountable linear light, as recited in claim 1, wherein said first continuous wing member has converging surfaces.

4. The continuously mountable linear light, as recited in claim 3, wherein said first continuous wing member is made of polyvinyl chloride.

5. The continuous mountable linear light as recited in claim 3, further including a plurality of slits formed on said first continuous wing member enabling said first continuous wing member to bend when mounted on a the support surface.

6. The continuous mountable linear light as recited in claim 1, further including a plurality of slits formed on said first continuous wing member enabling said first continuous wing member to bend when mounted on the support surface.

7. The continuously mountable linear light, as recited in claim 1, further including a second continuous wing member extending laterally from said outer sheath casing.

8. The continuous mountable linear light, as recited in claim 7, wherein said second continuous wing member extends from said outer sheath casing on an opposite side of first continuous wing member.

9. The continuous mountable linear light, as recited in claim 8, wherein said second continuous wing member is made of polyvinyl chloride.

10. The continuous mountable linear light, as recited in claim 7, wherein said second continuous wing member has converging surfaces.

* * * * *